US012359366B2

(12) United States Patent
Yan

(10) Patent No.: US 12,359,366 B2
(45) Date of Patent: Jul. 15, 2025

(54) GARMENT STEAMER WITH INCLINATION-ANGLE-ADJUSTABLE IRONING BOARD

(71) Applicant: Ningbo Kaibo GROUP Co., Ltd., Ningbo (CN)

(72) Inventor: Jiebo Yan, Ningbo (CN)

(73) Assignee: Ningbo Kaibo GROUP Co., Ltd., Ningbo (CN)

( * ) Notice: Subject to any disclaimer, the term of this patent is extended or adjusted under 35 U.S.C. 154(b) by 0 days.

(21) Appl. No.: 18/392,780

(22) Filed: Dec. 21, 2023

(65) Prior Publication Data

US 2025/0129542 A1 Apr. 24, 2025

(30) Foreign Application Priority Data

Oct. 19, 2023 (CN) ..... 202311365176.2
Oct. 19, 2023 (CN) ..... 202322829097.4

(51) Int. Cl.
*D06F 81/08* (2006.01)
*D06F 81/04* (2006.01)

(52) U.S. Cl.
CPC ..... *D06F 81/08* (2013.01); *D06F 81/04* (2013.01)

(58) Field of Classification Search
CPC ..... D06F 81/08; D06F 81/04; D06F 81/00; D06F 81/02; D06F 81/10; D06F 81/12
See application file for complete search history.

(56) References Cited

U.S. PATENT DOCUMENTS 1,583,280 A * 5/1926 Cummings ..... A47B 5/04 248/240.1
1,866,450 A * 7/1932 Burnley ..... A47B 27/02 108/9
3,288,090 A * 11/1966 King ..... D06F 81/04 108/138
5,004,206 A * 4/1991 Anderson ..... B60N 2/507 267/225

(Continued)

FOREIGN PATENT DOCUMENTS

CN 107075782 A 8/2017
DE 102004021314 A1 * 11/2005 ..... D06F 81/04
WO WO-2019174363 A1 * 9/2019 ..... D06F 73/00

*Primary Examiner* — Ismael Izaguirre
(74) *Attorney, Agent, or Firm* — MUNCY, GEISSLER, OLDS & LOWE, P.C.

(57) ABSTRACT

A garment steamer with inclination-angle-adjustable ironing board. An ironing board is attached to an upper end of a support structure through an angle adjustment mechanism which includes a base frame, first connecting rod, second connecting rod, and shape-fixing connecting rod. The first and second connecting rod are connected between the base frame and ironing board to form a quadrilateral. The quadrilateral shape is changed by swinging the first and second connecting rod relative to the base frame. The shape of the quadrilateral is fixed using the shape-fixing connecting rod to prevent the quadrilateral from deforming and to fix the ironing board at a desired position. The garment steamer maintains integrity and stability of the support structure, the quadrilateral does easily loosen when fixed by the shape-fixing connecting rod, and the ironing board is stably supported and can be adjusted to any inclination angle through deformation of the quadrilateral.

18 Claims, 13 Drawing Sheets

(56) References Cited

U.S. PATENT DOCUMENTS

| | | | | |
|---|---|---|---|---|
| 5,865,414 | A * | 2/1999 | Beitzel | A47B 21/00 248/447 |
| 7,757,618 | B2 * | 7/2010 | Chang | A47B 9/12 248/421 |
| 9,888,766 | B2 * | 2/2018 | Chuang | F16M 11/2014 |

* cited by examiner

GARMENT STEAMER WITH INCLINATION-ANGLE-ADJUSTABLE IRONING BOARD

TECHNICAL FIELD

The present invention belongs to the field of clothing ironing devices, and in particular relates to a garment steamer with an inclination-angle-adjustable ironing board.

BACKGROUND

Invention patent application No. CN107075782A discloses a garment steamer with inclinable ironing board, which includes: a base; a support structure extending upwardly from the base, the support structure including an upper part and a lower part; an ironing board attached to the upper part; an inclination structure including an inclination connecting rod connected to the upper part and the lower part in such a way that the upper part is inclinable relative to the lower part and the upper part is fixable at a position where the upper part is inclined from the lower part at an angle between a horizontal position and a vertical position. The inclination connecting rod includes a first connecting rod arm and a second connecting rod arm extending abreast between the upper part and the lower part of the support structure. Each of the first connecting rod arm and the second connecting rod arm includes an upper end pivotably connected to the upper part and a lower end pivotably connected to the lower part. The first connecting rod arm is longer than the second connecting rod arm such that the upper part is an inclined position relative to the lower part when the upper end and the lower end of the connecting rod arms are respectively pivoted about the upper part and the lower part of the support structure.

The inclined structure of the garment steamer allows the upper part of the support structure to be inclined relative to the lower part, making the support structure relatively fragile.

Moreover, in an embodiment, the first connecting arm and the second connecting arm are surrounded by a sleeve to maintain the first connecting arm and the second connecting arm at a first position where the upper part is not inclined relative to the lower part. Alternatively, in another embodiment, the inclination connecting rod includes an upper connecting rod pivotally connected to a lower connecting rod. The lower connecting rod includes a circular end and a plurality of recesses radially limited within the circular end. A spring loaded with a plunger is provided inside the upper connecting rod and biases against the circular end of the lower connecting rod, so that when the plunger aligns with one of the recess, the plunger is positioned in the recess to lock the upper connecting rod at an inclined position relative to the lower connecting rod. This structure which achieves surrounding through the sleeve and alignment with the recess through the plunger is relatively concentrated in stress. Any external torque (such as the deviation of the center of gravity of the ironing board, the bias of the clothes carried by the ironing board during ironing, and the pressure of ironing) can cause excessive fatigue, early wear, and deformation to the surrounding area of the sleeve and the fitting between the plunger and the recess, resulting in damage or looseness of the surrounding area of the sleeve and the fitting between the plunger and the recess, and making the support structure unstable.

SUMMARY

The technical problem to be solved by the present invention and the proposed technical task are respectively to overcome the defect of unstable support structure caused by the inclination structure of the existing garment steamer and to provide a garment steamer with an inclination-angle-adjustable ironing board, so as to ensure the stability of the support structure, ensure the stability of the ironing board relative to the support structure, and improve the service life.

In order to achieve the purpose, the garment steamer with the inclination-angle-adjustable ironing board provided by the present invention includes:

- a support structure extending in a vertical direction; and
- an ironing board attached to an upper end of the support structure through an angle adjustment mechanism,
- the angle adjustment mechanism including a base frame, a first connecting rod, a second connecting rod, and a shape-fixing connecting rod, the first connecting rod including a first end and a second end, the second connecting rod including a third end and a fourth end, the first end and the third end being assembled on the base frame in a swingable manner, the second end and the fourth end being assembled on the ironing board in a swingable manner, the first end, the second end, the third end and the fourth end serving as four vertices of a quadrilateral and causing the first connecting rod and the second connecting rod to change the shape of the quadrilateral when swinging relative to the base frame to help the ironing board to change the inclination angle relative to the base frame, the shape-fixing connecting rod being configured to fix the shape of the quadrilateral and prevent the quadrilateral from being deformed.

In the garment steamer, the support structure is not divided into an upper part and a lower part that are relatively inclinable, thus maintaining the integrity and stability of the support structure. Moreover, the ironing board is attached to the upper end of the support structure through the angle adjustment mechanism to achieve the adjustment of the inclination angle. By changing the shape of the quadrilateral, the ironing board changes the inclination angle relative to the base frame. By configuring the shape-fixing connecting rod to fix the shape of the quadrilateral to prevent the quadrilateral from being deformed, the quadrilateral does not get loose easily when fixed by the shape-fixing connecting rod, the ironing board can be stably supported, and the service life of the angle adjustment mechanism is prolonged. Further, due to the continuous deformation of the quadrilateral, the ironing board can be adjusted to any inclination angle instead of being limited to certain specific positions.

In order to be suitable for ironing in various postures, the ironing board is placed vertically, horizontally or at any inclination angle therebetween with the change of the shape of the quadrilateral. When the ironing board is placed vertically, it is suitable for vertical ironing; when the ironing board is placed horizontally, it is suitable for horizontal ironing; when the ironing board is at an inclination angle, it is suitable for inclined ironing.

In order to stably support the ironing board, the angle adjustment mechanism supports the ironing board in a V shape when the ironing board is placed horizontally. This increases the ability of the ironing board to resist external torque and maintains stability during ironing. Specifically, the base frame is provided with an inclination arm, the first end of the first connecting rod is connected to a lower end of the inclination arm, and the third end of the second connecting rod is connected to an upper end of the inclination arm, and the inclination arm and the first connecting rod form a V shape when the ironing board is placed horizontally. This structure relies on the swing of the first connecting rod to support and change the posture of the ironing board, and provides stable support for the ironing board.

In order to make the product structure compact, the first connecting rod is close to the ironing board when the ironing board is placed vertically, and the second connecting rod is close to the ironing board when the ironing board is placed horizontally.

In order to improve the stability of supporting the ironing board, the first connecting rod and the second connecting rod support the ironing board in at least two positions in a width direction of the ironing board.

The shape-fixing connecting rod is configured to fix the first connecting rod, the second connecting rod, or the ironing board to fix the shape of the quadrilateral and prevent the quadrilateral from being deformed. Since the shape of the quadrilateral is not fixed, in this application, the position of one side determined by the first end and the third end is fixed, and the positions of three sides determined by the first connecting rod, the second connecting rod, the second end and the fourth end are variable. Therefore, when the first connecting rod, the second connecting rod or the ironing board is fixed, the quadrilateral can be prevented from being deformed, so that the ironing board is fixed.

In an embodiment, the shape-fixing connecting rod is a telescopic rod that changes in length with the change of the shape of the quadrilateral, and the telescopic rod is provided with a length-fixing locking structure. Therefore, when the ironing board is adjusted to the desired inclined position through the change of the shape of the quadrilateral, the length-fixing locking structure locks the length of the shape-fixing connecting rod, thus fixing the posture of the ironing board and facilitating the operation.

Specifically, one type of the telescopic rod is a gas spring, the length-fixing locking structure is provided with a first handle, the length of the gas spring remains unchanged when the first handle is released, and the length of the gas spring is changeable with the change of the shape of the quadrilateral when the first handle is operated. In order to facilitate the operation, the first handle is located at one end of a back side of the ironing board, so that it can be held to adjust the posture of the ironing board accordingly when the first handle is operated. Another type of the telescopic rod is composed of a first rod and a second rod that are sleeved together, and the length-fixing locking structure is a lock catch provided at a sleeving position.

In order to reliably stabilize the shape of the quadrilateral and prevent the quadrilateral from being deformed, two ends of the telescopic rod are respectively connected to components where different sides of the quadrilateral are located. Therefore, the telescopic rod can be made to have a larger length and generate a greater torque resisting the deformation of the quadrilateral.

In an embodiment, the shape-fixing connecting rod is a swing rod connected in swingable manner to the component where either side of the quadrilateral is located, the swing rod is provided with a movable locking member, a locking hole is provided in the movable locking member, the swing rod passes through the locking hole, the movable locking member uses the elastic force of an elastic element to cause the locking hole to lock the swing rod to prevent the swing rod from moving along the length of the swing rod within the locking hole and fix the quadrilateral, and overcoming the elastic force of the elastic element causes the locking hole to unlock the swing rod to allow the swing rod to move along the length of the swing rod within the locking hole and allow the quadrilateral to be deformed. Therefore, by controlling the movement of the swing rod, the posture of the ironing board can be adjusted and the ironing board can be fixed in the desired posture.

To facilitate the operation, the movable locking member is provided with a second handle.

In order to facilitate the operation of the movable locking member, the movable locking member is connected to an actuating member through a connecting rod, the elastic element acts on the actuating member, and the actuating member is provided with a second handle.

Exemplarily, in order to make the structure compact, the movable locking member and the actuating member are assembled on a back side of the ironing board through a shaft. In addition, the swing rod is assembled on the first connecting rod, the second connecting rod, or the ironing board.

In an embodiment, the base frame and the support structure are integrally manufactured.

In another embodiment, the base frame is assembled on the support structure.

In the present invention, an ironing board is attached to an upper end of a support structure through an angle adjustment mechanism. The angle adjustment mechanism includes a base frame, a first connecting rod, a second connecting rod, and a shape-fixing connecting rod. The first connecting rod and the second connecting rod are connected between the base frame and the ironing board to form a quadrilateral. The shape of the quadrilateral is changed by swinging the first connecting rod and the second connecting rod relative to the base frame to help the ironing board to change the inclination angle relative to the base frame. The shape of the quadrilateral is fixed by using the shape-fixing connecting rod to prevent the quadrilateral from being deformed and fix the ironing board at a desired position.

In the garment steamer, the support structure is not divided into an upper part and a lower part that are relatively inclinable, thus maintaining the integrity and stability of the support structure. Moreover, the quadrilateral does not get loose easily when fixed by the shape-fixing connecting rod, the ironing board can be stably supported, and the service life of the angle adjustment mechanism is prolonged. Further, due to the continuous deformation of the quadrilateral, the ironing board can be adjusted to any inclination angle instead of being limited to certain specific positions.

DESCRIPTION OF REFERENCE SIGNS

Figure 1:
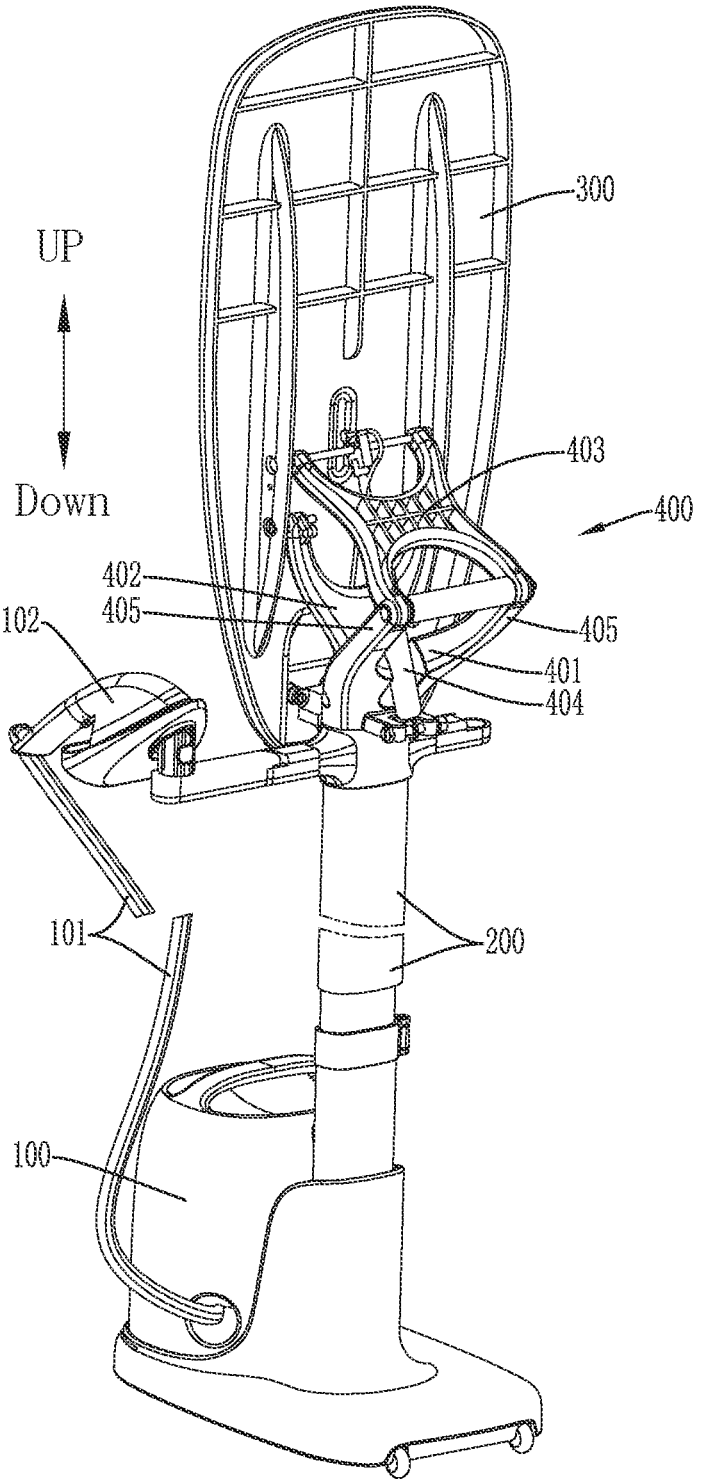
FIG. 1 illustrates an axial-side diagram of a garment stream according to embodiment 1 of the present invention.
Figure 2:
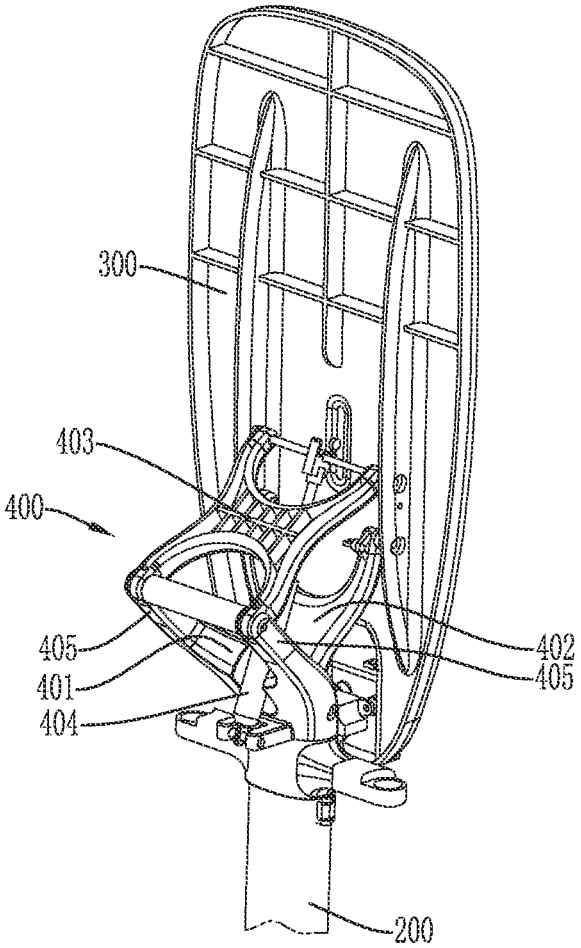
FIG. 2 illustrates a schematic diagram in another view of a support structure and an ironing board in FIG. 1.
Figure 3:
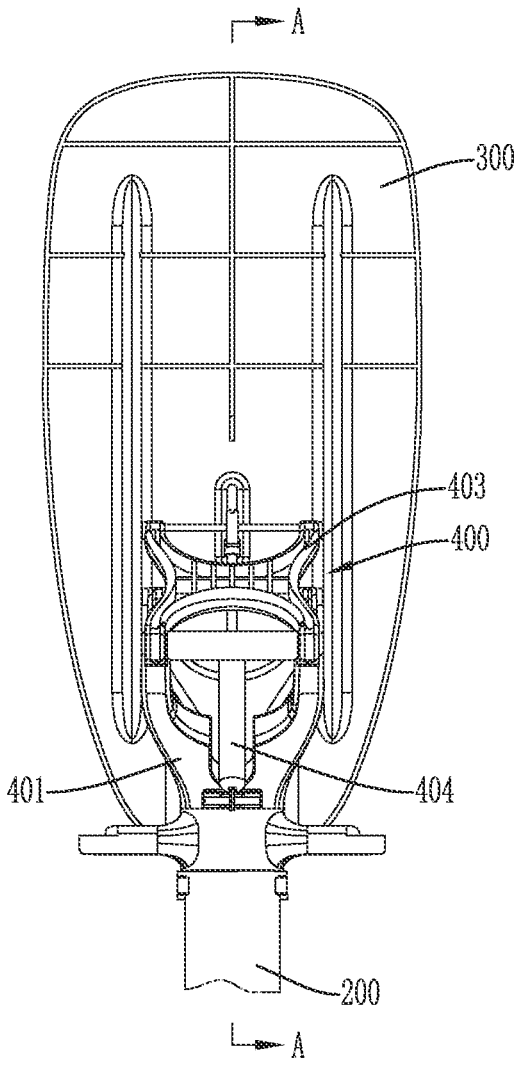
FIG. 3 illustrates a schematic diagram of an orthographic projection of a structure illustrated in FIG. 2.

100—main machine, 101—steam pipe, 102—steam nozzle;

200—support structure;

300—ironing board;

400—angle adjustment mechanism: 401—base frame, 402—first connecting rod, 403—second connecting rod, 404—shape—fixing connecting rod, A—first end, D—second end, B—third end, C—fourth end, ABCD—quadrilateral, E—fifth end, F—sixth end, 405—inclination arm, 406—first handle, 407—first connecting rod, 408—second connecting rod, 409—lock catch, 410—movable locking member, 411—locking hole, 412—elastic element, 413—second handle, 414—connecting rod, 415—actuating mechanism.

DESCRIPTION OF THE EMBODIMENTS

In order to make the purpose, technical solution, and advantages of the present invention clearer, the following will provide a clear and complete description of the technical solution in the embodiments of the present invention in conjunction with the drawings. Obviously, the described embodiments are part of the embodiments of the present invention, not all of them. Based on the embodiments in the present invention, all other embodiments obtained by those skilled in the art without contributing any inventive labor still fall within the scope of protection of the present invention.

The terms "including" and "comprising in the description and claims of the present invention, as well as any variations thereof, are intended to cover non-exclusive inclusion. For example, a method or product that includes a series of technical features, is not necessarily limited to those clearly listed, but may also include other technical features that are not clearly listed and can be included in the method or product.

In the description of the present invention, it should be understood that the orientation or position relationships indicated by the terms "up", "down" and the like are based on the orientation or position relationships illustrated in the drawings, are only for the convenience of describing the present invention and simplifying the description, instead of indicating or implying that the device or element referred to must have a specific orientation or be constructed and operated in a specific orientation, and thus cannot be understood as limitations on the present invention. Directions "up" and "down" are opposite.

In the description of the present invention, it should be understood that the technical features defined by the terms "first", "second", "third", "fourth", "fifth", "sixth" and other sequential concepts are only for the purpose of clearly describing the limited technical features and distinguishing them from other technical features, do not represent such naming in actual implementation, and thus cannot be understood as limitations on the present invention.

The present invention will be described below in detail in combination with the specific embodiments with reference to the drawings.

Embodiment 1

Referring to FIG. 1 to FIG. 9, a garment steamer in this embodiment includes a main machine 100, a support structure 200, an ironing board 300, and an angle adjustment mechanism 400.

The main machine 100 is configured to generate steam. The main machine is connected to a steam nozzle 102 through a steam pipe 101. The steam generated by the main machine is delivered to the steam nozzle through the steam pipe and released for ironing clothes.

In this embodiment, the support structure 200 is a support rod extending up and down. The support rod can be retracted to adjust its length. A lower end of the support rod is fixed to the main machine. In other embodiments, the lower end of the support structure may be configured to be a placement position. The main machine is placed at the placement position, so that the main machine can move together with the support structure, or the main machine can be removed from the placement position for separate movement to provide convenience for use.

The ironing board 300 is attached to an upper end of the support structure 200 through the angle adjustment mechanism 400, that is, the angle adjustment mechanism is configured between the ironing board 300 and the support structure 200, rather than that the ironing board is directly assembled at the upper end of the support structure.

The angle adjustment mechanism 400 includes a base frame 401, a first connecting rod 402, a second connecting rod 403, and a shape-fixing connecting rod 404. In this embodiment, the angle adjustment mechanism is assembled as an independent part at the upper end of the support structure, and specifically assembled on the upper end of the support structure 200 through the base frame 401. In this way, the base frame and the support structure can be made of different materials according to structural strength and functional requirements. In other embodiments, the base frame and the support structure may also be integrally manufactured. The first connecting rod 402 includes a first end A and a second end D. The second connecting rod 403 includes a third end B and a fourth end C. The first end A and the third end B are assembled on the base frame 401 in a swingable manner. The second end D and the fourth end C are assembled on a back side of the ironing board 300 in a swingable manner. The first end A, the second end D, the third end B, and the fourth end C serve as four vertices of a quadrilateral ABCD illustrated in FIG. 5 to FIG. 7 and cause the first connecting rod 402 to change the shape of the quadrilateral ABCD when swinging relative to the base frame 401 to help the ironing board 300 to change the inclination angle relative to the base frame 401. The shape-fixing connecting rod 404 is configured to fix the shape of the quadrilateral ABCD to prevent the quadrilateral ABCD from being deformed.

Figure 4:
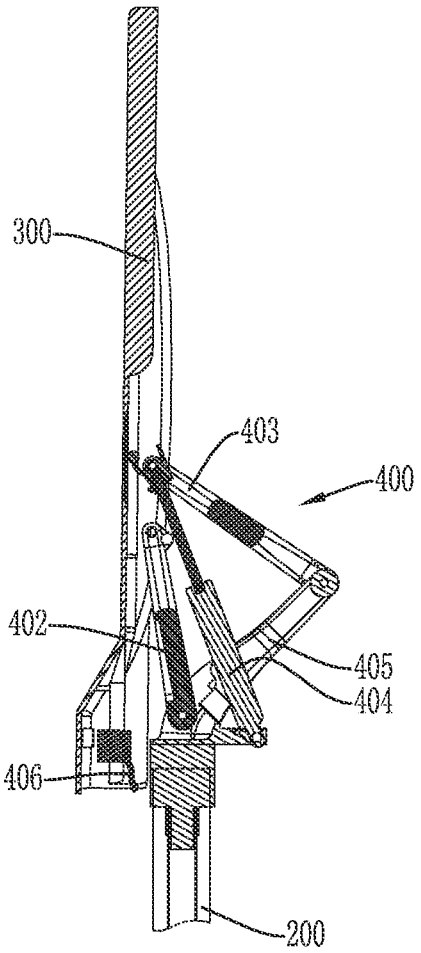
FIG. 4 illustrates an A-A sectional diagram of FIG. 3.
Figure 5:
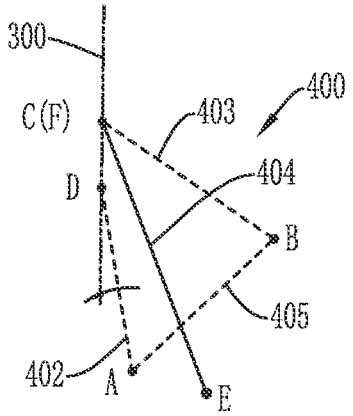
FIG. 5 illustrates a model diagram that an ironing board, a first connecting rod, a second connecting rod and a base frame in FIG. 4 form a quadrilateral that is fixed by a shape-fixing connecting rod.
Figure 6:
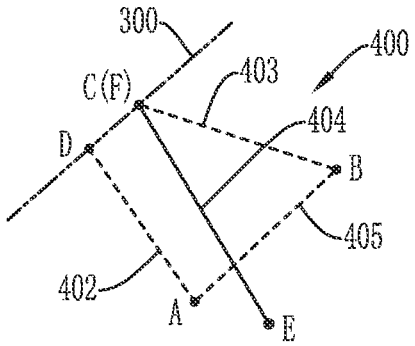
FIG. 6 illustrates a schematic diagram that a quadrilateral illustrated in FIG. 5 changes to a shape that an ironing board is adjusted to an inclined state.
Figure 7:
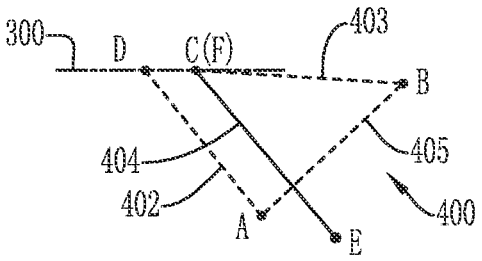
FIG. 7 illustrates a schematic diagram that a quadrilateral illustrated in FIG. 6 changes to a shape that an ironing board is adjusted to a horizontally placed state.
Figure 8:
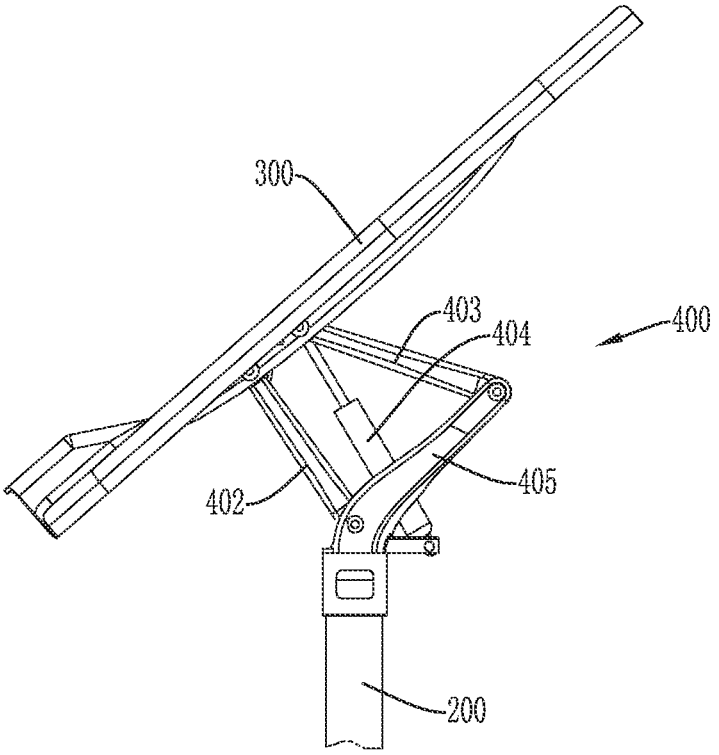
FIG. 8 illustrates a view of a product corresponding to a state illustrated in FIG. 6.

In order to be suitable for ironing in various postures, the ironing board 300 is placed vertically as illustrated in FIG. 4 and FIG. 5, horizontally as illustrated in FIG. 7 and FIG. 8 or at any inclination angle therebetween as illustrated in FIG. 6 and FIG. 8 with the change of the shape of the quadrilateral ABCD. When the ironing board 300 is placed vertically, it is suitable for vertical ironing; when the ironing board is placed horizontally, it is suitable for horizontal ironing; when the ironing board is at an inclination angle, it is suitable for inclined ironing.

In order to stably support the ironing board, the angle adjustment mechanism 400 supports the ironing board in a V shape when the ironing board is placed horizontally. This increases the ability of the ironing board to resist external torque and maintains stability during ironing. Specifically, the base frame 401 is provided with an inclination arm 405. The first end A of the first connecting rod 402 is connected to a lower end of the inclination arm 405. The third end B of the second connecting rod 403 is connected to an upper end of the inclination arm 405. The inclination arm 405 and the first connecting rod 402 form a V shape when the ironing board 300 is placed horizontally. In addition, the first connecting rod 402 and the second connecting rod 403 support the ironing board in at least two positions in a width direction of the ironing board. In the figures, the first connecting rod 402 is in a Y shape, a lower end thereof is connected as the first end A to the lower end of the inclination arm 405, an upper end thereof is connected as the second end D to the edge of the back side of the ironing board 300. The second connecting rod 403 is in an H shape, a lower end thereof is connected as the third end B to the upper end of the inclination arm 405, and an upper end thereof is connected as the fourth end C to the edge of the back side of the ironing board 300. The upper end of the correspondingly inclination arm has a corresponding width and is provided with two support arms. The two support arms are correspondingly connected to the upper ends of the H-shaped second connecting rod 403 one to one.

Figure 9:
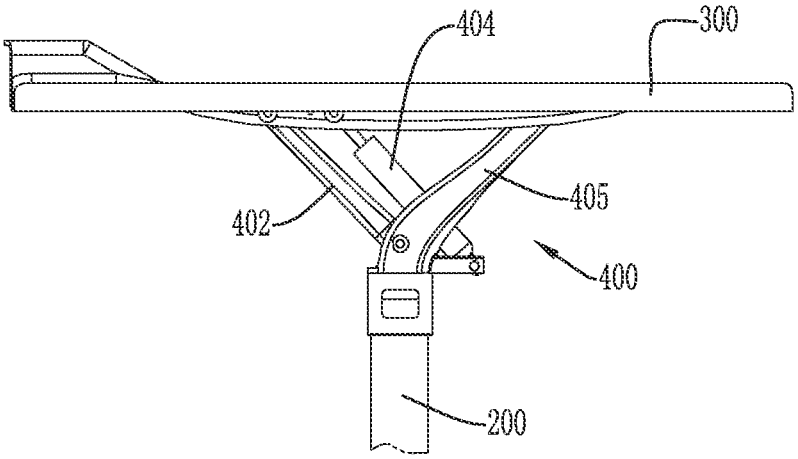
FIG. 9 illustrates a view of a product corresponding to a state illustrated in FIG. 7.

In order to make the product structure compact, the first connecting rod 402 is close to the ironing board 300 when the ironing board 300 is placed vertically as illustrated in FIG. 1 to FIG. 5, and the second connecting rod 403 is close to the ironing board 300 when the ironing board 300 is placed horizontally as illustrated in FIG. 7 and FIG. 9.

In this embodiment, the shape-fixing connecting rod 404 is configured to fix the first connecting rod, the second connecting rod, or the ironing board to fix the shape of the quadrilateral and prevent the quadrilateral from being deformed. Referring to FIG. 5 to FIG. 7, the shape-fixing connecting rod 404 includes a fifth end E and a sixth end F, the fifth end E of the shape-fixing connecting rod is connected to the lower end of the inclination arm 405, and the sixth end F of the shape-fixing connecting rod is connected to the back side of the ironing board 300, so that the first connecting rod, the second connecting rod, and the shape-fixing connecting rod jointly support the ironing board after the shape of the quadrilateral ABCD is fixed by the shape-fixing connecting rod. In other embodiments, the upper and lower ends of the shape-fixing connecting rod may also be connected at other positions to fix the shape of the quadrilateral ABCD.

In this embodiment, the shape-fixing connecting rod 404 is a telescopic rod that changes in length with the change of the shape of the quadrilateral, and the telescopic rod is provided with a length-fixing locking structure. Therefore, when the ironing board is adjusted to the desired inclined position by changing the shape of the quadrilateral, the length of the shape-fixing connecting rod can be locked through the length-fixing locking structure, thus fixing the posture of the ironing board and facilitating the operation. Specifically, in this embodiment, the telescopic rod is a gas spring, the length-fixing locking structure is provided with a first handle 406, the length of the gas spring remains unchanged when the first handle is released, and the length of the gas spring is changeable with the change of the shape of the quadrilateral when the first handle is operated. In order to facilitate the operation, the first handle 406 is located at one end of a back side of the ironing board 300, so that it can be held to adjust the posture of the ironing board accordingly when the first handle is operated. In order to reliably stabilize the shape of the quadrilateral and prevent the quadrilateral from being deformed, two ends of the telescopic rod are respectively connected to components where different sides of the quadrilateral are located. Therefore, the telescopic rod can be made to have a larger length and generate a greater torque resisting the deformation of the quadrilateral.

For the garment steamer in this embodiment, in a natural state, the length of the gas spring as the shape-fixing connecting rod 404 is fixed and the shape of the quadrilateral ABCD is determined, so that the ironing board can be fixed at any inclined position illustrated in FIG. 6 and FIG. 8. By operating the first handle 406, the length of the gas spring can change. After the first connecting rod 402 and the second connecting rod 403 are swung clockwise from the inclined state illustrated in FIG. 6 and FIG. 8, the ironing board is adjusted to the vertically placed state illustrated in FIG. 4 and FIG. 5; on the contrary, after the first connecting rod 402 and the second connecting rod 403 are swung anticlockwise from the vertically placed state illustrated in FIG. 4 and FIG. 5, the ironing board is adjusted to the inclined state illustrated in FIG. 6 and FIG. 8. After the first connecting rod 402 and the second connecting rod 403 are swung anticlockwise from the inclined state illustrated in FIG. 6 and FIG. 8, the ironing board is adjusted to the horizontally placed state illustrated in FIG. 7 and FIG. 9; on the contrary, after the first connecting rod 402 and the second connecting rod 403 are swung clockwise from the horizontally placed state illustrated in FIG. 7 and FIG. 9, the ironing board is adjusted to the inclined state illustrated in FIG. 6 and FIG. 8. When the ironing board is adjusted to the vertically placed state illustrated in FIG. 4 and FIG. 5, the horizontally placed state illustrated in FIG. 7 and FIG. 9, and any inclined position illustrated in FIG. 6 and FIG. 8, the handle is released and unlocked, and the length of the gas spring is determined, thus fixing the shape of the quadrilateral ABCD and fixing the ironing board at the corresponding position. In addition to the first handle, the length-fixing locking structure further includes a cable connecting the first handle and the gas spring, so that the first handle is operated like a brake handle and the gas spring is locked at a fixed length by the length-fixing locking structure under normal circumstances. By operating the first handle to drag the cable, the length-fixing locking structure can unlock the gas spring, so that the length of the gas spring is changed with the change of the shape of the quadrilateral.

Embodiment 2

Figure 10:
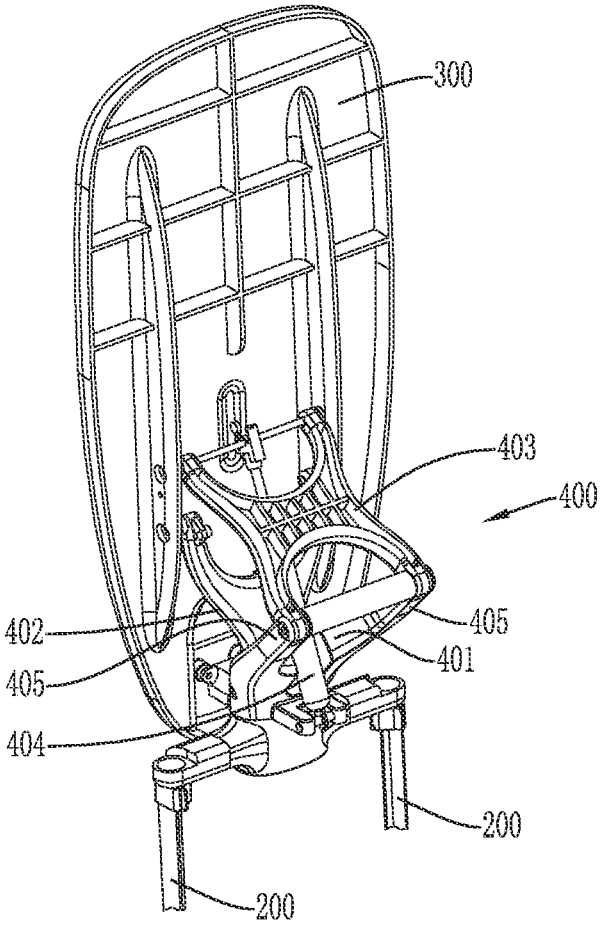
FIG. 10 illustrates a partial axial-side diagram of a garment steamer according to embodiment 2 of the present invention.

Referring to FIG. 10, the difference of this embodiment from embodiment 1 only lies in the support structure. The support structure 200 in this embodiment is a pair of support rods, thus increasing the stability of the support structure. Other structures are the same as those in embodiment 1, which will not be repeated here.

Embodiment 3

Figure 11:
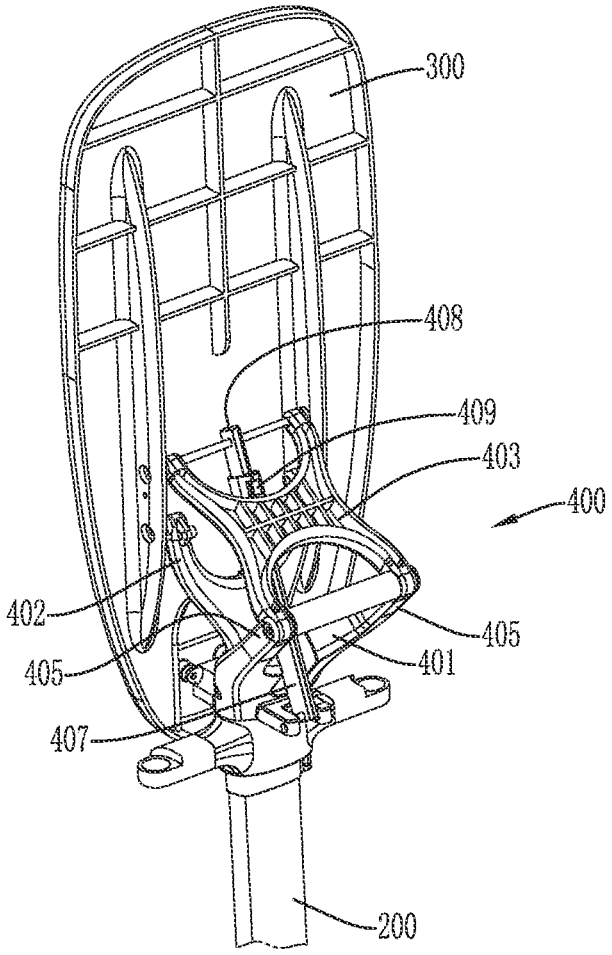
FIG. 11 illustrates a partial axial-side diagram of a garment steamer according to embodiment 3 of the present invention.
Figure 12:
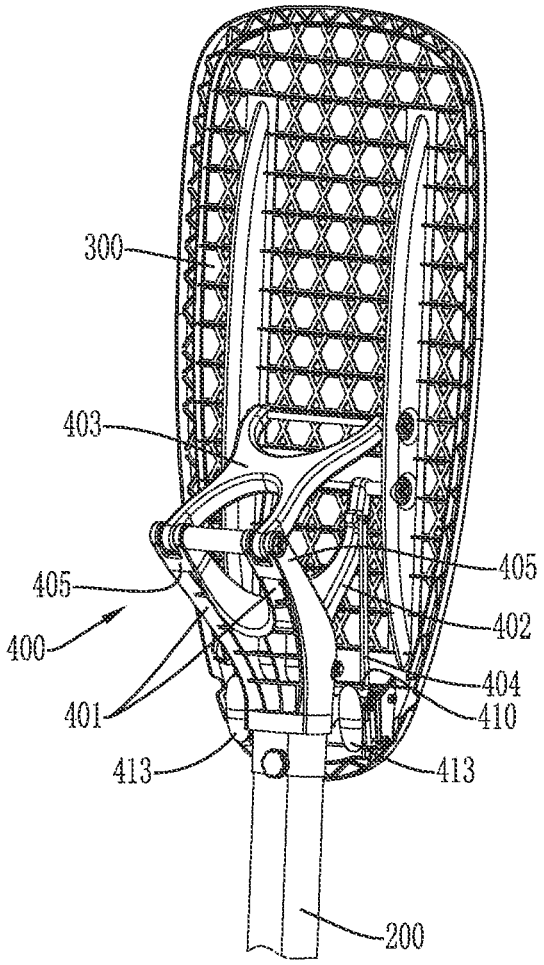
FIG. 12 illustrates a partial axial-side diagram of a garment steamer according to embodiment 4 of the present invention.
Figure 13:
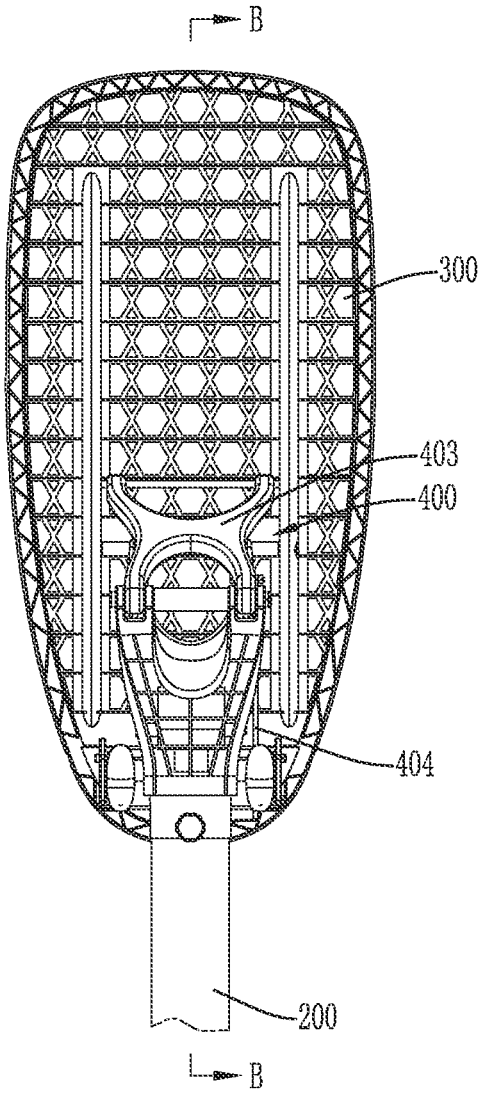
FIG. 13 illustrates a schematic diagram of an orthographic projection of a structure illustrated in FIG. 12.
Figure 14:
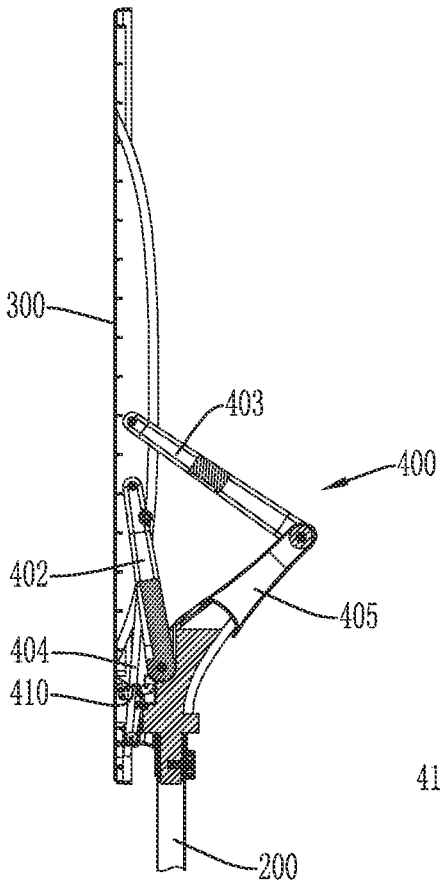
FIG. 14 illustrates a B-B sectional diagram of FIG. 13.
Figure 15:
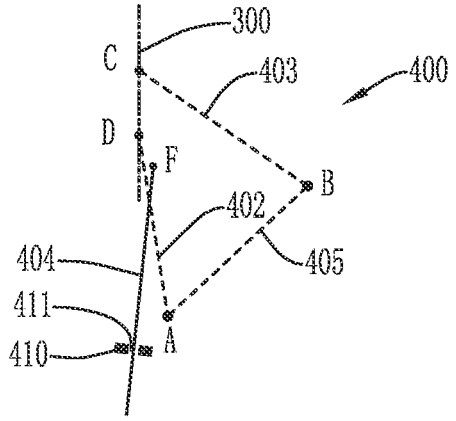
FIG. 15 illustrates a model diagram that an ironing board, a first connecting rod, a second connecting rod and a base frame in FIG. 14 form a quadrilateral that is fixed by a shape-fixing connecting rod.
Figure 16:
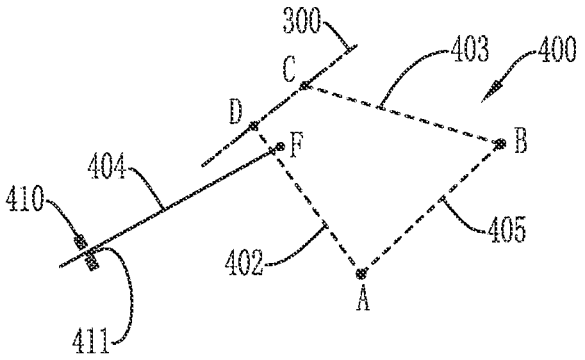
FIG. 16 illustrates a schematic diagram that a quadrilateral illustrated in FIG. 15 changes to a shape that an ironing board is adjusted to an inclined state.
Figure 17:
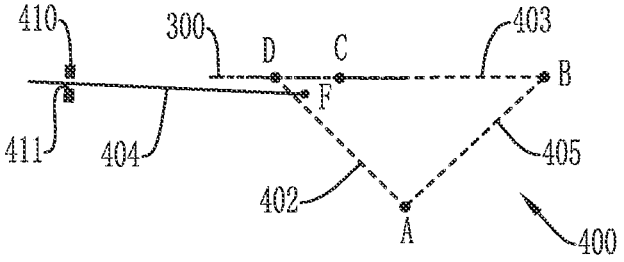
FIG. 17 illustrates a schematic diagram that a quadrilateral illustrated in FIG. 16 changes to a shape that an ironing board is adjusted to a horizontally placed state.
Figure 18:
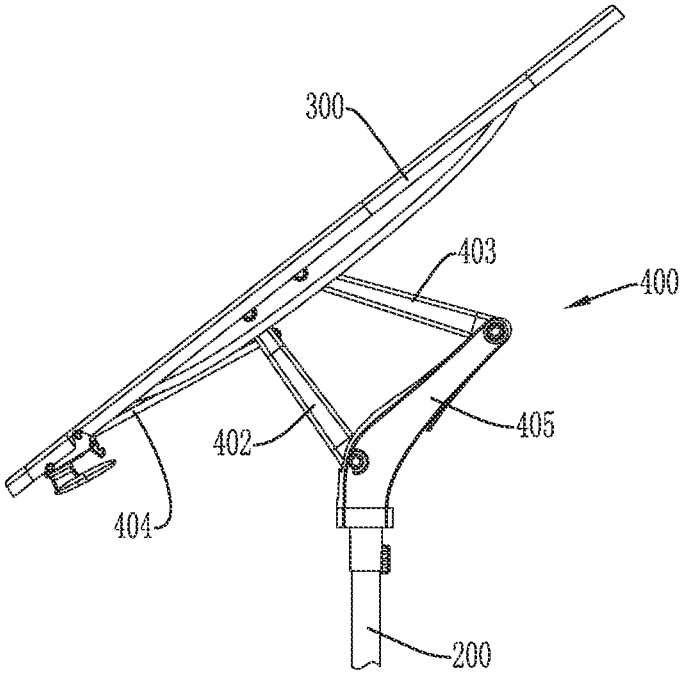
FIG. 18 illustrates a view of a product corresponding to a state illustrated in FIG. 16.
Figure 19:
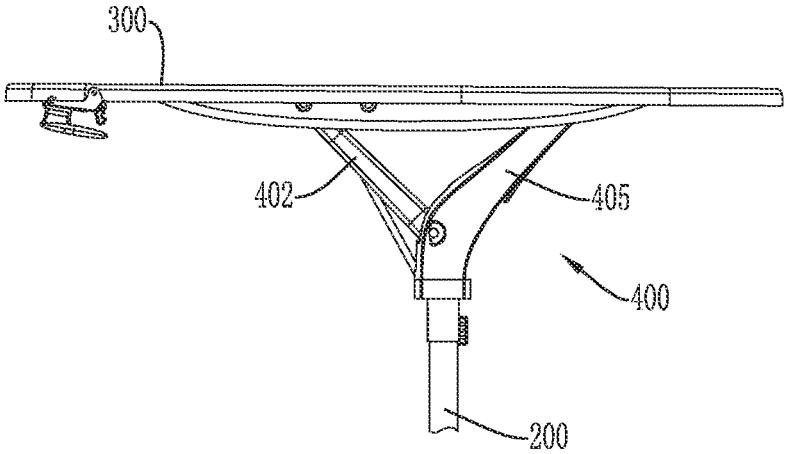
FIG. 19 illustrates a view of a product corresponding to a state illustrated in FIG. 17.
Figure 20:
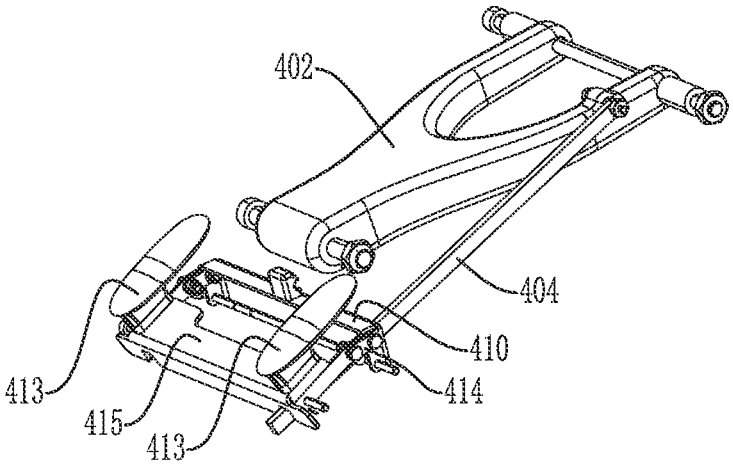
FIG. 20 illustrates a schematic diagram of configuration in a first perspective of a shape-fixing connecting rod in embodiment 4.
Figure 21:
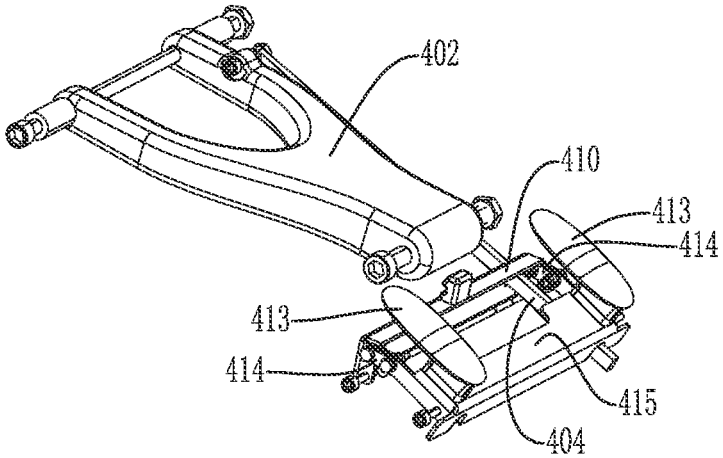
FIG. 21 illustrates a schematic diagram of configuration in a second perspective of a shape-fixing connecting rod in embodiment 4.
Figure 22:
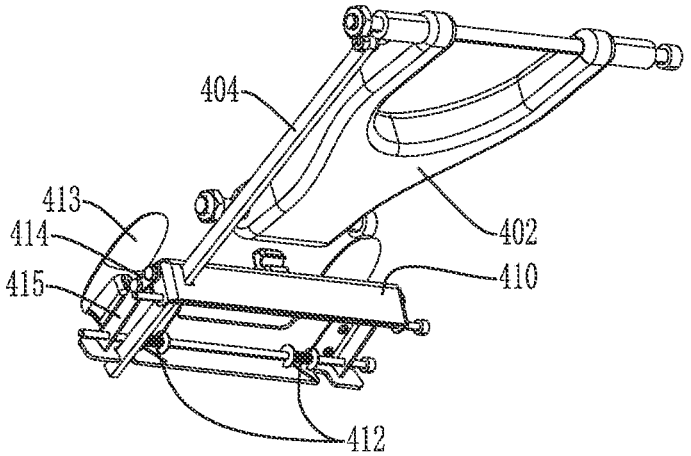
FIG. 22 illustrates a schematic diagram of configuration in a third perspective of a shape-fixing connecting rod in embodiment 4.
Figure 23:
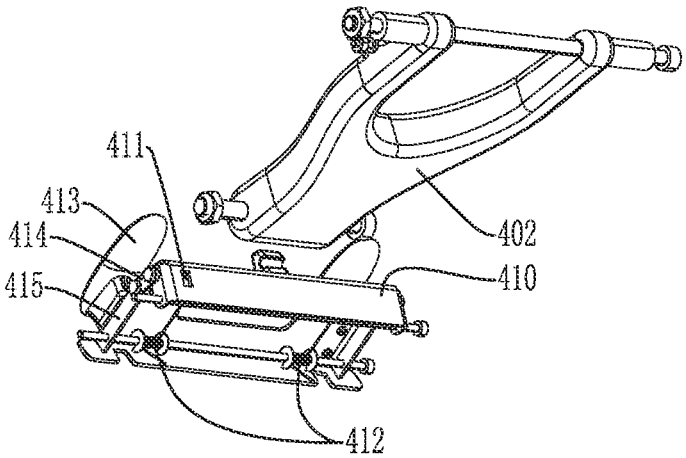
FIG. 23 illustrates a schematic diagram that a shape-fixing connecting rod is removed from a structure illustrated in FIG. 22.

Referring to FIG. 11, the difference of this embodiment from embodiment 1 only lies in the structural form of the shape-fixing connecting rod 404. In this embodiment, the telescopic rod serving as the shape-fixing connecting rod is composed of a first rod 407 and a second rod 408 that are sleeved together, and the length-fixing locking structure is a lock catch 409 provided at a sleeving position. This type of lock catch is like a lock catch on the support rod serving as the support structure, so that the length of the telescopic rod can be adjusted and locked at the corresponding length like the support rod. Other structures in this embodiment are the same as those in embodiment 1, which will not be repeated here.

Embodiment 4

Referring to FIG. 12 to FIG. 23, the difference of this embodiment from embodiment 1 only lies in the structural form of the shape-fixing connecting rod 404. In this embodiment, the shape-fixing connecting rod 404 is a swing rod connected in swingable manner to the component where either side of the quadrilateral is located. The second end F of the swing rod illustrated is connected to the first connecting rod 402 in a swingable manner. In other embodiments, the second end F of the swing rod may also be connected to the second connecting rod, the ironing board, or the base frame in a swingable manner. The swing rod is provided with a movable locking member 410. The movable locking member 410 is assembled on the back side of the ironing board 300 through a shaft. A locking hole 411 is provided in the movable locking member 410. The swing rod passes through the locking hole 411. The movable locking member 410 uses the elastic force of an elastic element 412 to cause the locking hole 411 to lock the swing rod to prevent the swing rod from moving along the length of the swing rod within the locking hole and fix the quadrilateral.

Overcoming the elastic force of the elastic element 412 causes the locking hole to unlock the swing rod to allow the swing rod to move along the length of the swing rod within the locking hole and allow the quadrilateral to be deformed. Therefore, by controlling the movement of the swing rod, the posture of the ironing board can be adjusted and the ironing board can be fixed in the desired posture. In order to facilitate the operation of the movable locking member, the movable locking member 410 is connected to an actuating member 415 through a connecting rod 414. The movable locking member 410 is parallel to the actuating member 415. The actuating member 415 is assembled on the back side of the ironing board 300 through a shaft. The elastic element 412 is a torsion spring that acts on the actuating member. The actuating member is provided with a second handle 413.

In other embodiments, the actuating member is omitted and the second handle is directly provided on the movable locking member, so that the elastic force of the elastic element can also be directly applied to the movable locking member.

For the garment steamer in this embodiment, in a natural state, the movable locking member 410 uses the elastic force of the elastic element 412 to lock the swing rod through the locking hole 411 to prevent the swing rod from moving along the length of the swing rod within the locking hole and fix the quadrilateral. The ironing board can be fixed at the vertically placed position illustrated in FIG. 14 and FIG. 15, the horizontally placed position illustrated in FIG. 17 and FIG. 19, and any inclined position illustrated in FIG. 16 and FIG. 18. The second handle 413 is operated to enable the actuating member to rotate and drive the movable locking member to rotate through the connecting rod. Overcoming the elastic force of the elastic element causes the locking hole to unlock the swing rod to allow the swing rod to move along the length of the swing rod within the locking hole and allow the quadrilateral to be deformed. After the first connecting rod and the second connecting rod are swung clockwise from the inclined state illustrated in FIG. 16 and FIG. 18, the ironing board is adjusted to the vertically placed state illustrated in FIG. 14 and FIG. 15; on the contrary, after the first connecting rod and the second connecting rod are swung anticlockwise from the vertically placed state illustrated in FIG. 14 and FIG. 15, the ironing board is adjusted to the inclined state illustrated in FIG. 16 and FIG. 18. After the first connecting rod and the second connecting rod are swung anticlockwise from the inclined state illustrated in FIG. 16 and FIG. 18, the ironing board is adjusted to the horizontally placed state illustrated in FIG. 17 and FIG. 19; on the contrary, after the first connecting rod and the second connecting rod are swung clockwise from the horizontally placed state illustrated in FIG. 17 and FIG. 19, the ironing board is adjusted to the inclined state illustrated in FIG. 16 and FIG. 18. When the ironing board is adjusted to the vertically placed state illustrated in FIG. 14 and FIG. 15, the horizontally placed state illustrated in FIG. 17 and FIG. 19, and any inclined position illustrated in FIG. 16 and FIG. 18, the second handle is released, the movable locking member uses the elastic force of an elastic element to cause the locking hole to lock the swing rod to prevent the swing rod from moving along the length of the swing rod within the locking hole and fix the quadrilateral, so that the ironing board is fixed.

Other structures in this embodiment are the same as those in embodiment 1, which will not be repeated here.

The invention claimed is:

1. A garment steamer with an inclination-angle-adjustable ironing board, comprising:

a support structure extending in a vertical direction; and an ironing board attached to an upper end of the support structure through an angle adjustment mechanism, the angle adjustment mechanism comprising a base frame, a first connecting rod, a second connecting rod, and a shape-fixing connecting rod, the first connecting rod comprising a first end and a second end, the second connecting rod comprising a third end and a fourth end, the first end and the third end being assembled on the base frame in a swingable manner, the second end and the fourth end being assembled on the ironing board in a swingable manner, the first end, the second end, the third end and the fourth end serving as four vertices of a quadrilateral and causing the first connecting rod and the second connecting rod to change the shape of the quadrilateral when swinging relative to the base frame to help the ironing board to change the inclination angle relative to the base frame, the shape-fixing connecting rod being configured to fix the shape of the quadrilateral and prevent the quadrilateral from being deformed, wherein the angle adjustment mechanism supports the ironing board in a V shape when the ironing board is placed horizontally.

2. The garment steamer with the inclination-angle-adjustable ironing board according to claim 1, wherein the ironing board is placed vertically, horizontally or at any inclination angle therebetween with the change of the shape of the quadrilateral.

3. The garment steamer with the inclination-angle-adjustable ironing board according to claim 1, wherein the base frame is provided with an inclination arm, the first end of the first connecting rod is connected to a lower end of the inclination arm, and the third end of the second connecting rod is connected to an upper end of the inclination arm, and the inclination arm and the first connecting rod form a V shape when the ironing board is placed horizontally.

4. The garment steamer with the inclination-angle-adjustable ironing board according to claim 1, wherein the first connecting rod is close to the ironing board when the ironing board is placed vertically, and the second connecting rod is close to the ironing board when the ironing board is placed horizontally.

5. The garment steamer with the inclination-angle-adjustable ironing board according to claim 1, wherein the first connecting rod and the second connecting rod support the ironing board in at least two positions in a width direction of the ironing board.

6. The garment steamer with the inclination-angle-adjustable ironing board according to claim 1, wherein the shape-fixing connecting rod is configured to fix the first connecting rod, the second connecting rod, or the ironing board to fix the shape of the quadrilateral and prevent the quadrilateral from being deformed.

7. The garment steamer with the inclination-angle-adjustable ironing board according to claim 1, wherein the shape-fixing connecting rod is a telescopic rod that changes in length with the change of the shape of the quadrilateral, and the telescopic rod is provided with a length-fixing locking structure.

8. The garment steamer with the inclination-angle-adjustable ironing board according to claim 7, wherein the telescopic rod is a gas spring, the length-fixing locking structure is provided with a first handle, the length of the gas spring remains unchanged when he first handle is released, and the length of the gas spring is changeable with the change of the shape of the quadrilateral when the first handle is operated.

9. The garment steamer with the inclination-angle-adjustable ironing board according to claim 8, wherein the first handle is located at one end of a back side of the ironing board.

10. The garment steamer with the inclination-angle-adjustable ironing board according to claim 7, wherein the telescopic rod is composed of a first rod and a second rod that are sleeved together, and the length-fixing locking structure is a lock catch provided at a sleeving position.

11. The garment steamer with the inclination-angle-adjustable ironing board according to claim 7, wherein two ends of the telescopic rod are respectively connected to components where different sides of the quadrilateral are located.

12. The garment steamer with the inclination-angle-adjustable ironing board according to claim 1, wherein the shape-fixing connecting rod is a swing rod connected in swingable manner to the component where either side of the quadrilateral is located, the swing rod is provided with a movable locking member, a locking hole is provided in the movable locking member, the swing rod passes through the locking hole, the movable locking member uses the elastic force of an elastic element to cause the locking hole to lock the swing rod to prevent the swing rod from moving along the length of the swing rod within the locking hole and fix the quadrilateral, and overcoming the elastic force of the elastic element causes the locking hole to unlock the swing rod to allow the swing rod to move along the length of the swing rod within the locking hole and allow the quadrilateral to be deformed.

13. The garment steamer with the inclination-angle-adjustable ironing board according to claim 12, wherein the movable locking member is provided with a second handle.

14. The garment steamer with the inclination-angle-adjustable ironing board according to claim 12, wherein the movable locking member is connected to an actuating member through a connecting rod, the elastic element acts on the actuating member, and the actuating member is provided with a second handle.

15. The garment steamer with the inclination-angle-adjustable ironing board according to claim 14, wherein the movable locking member and the actuating member are assembled on a back side of the ironing board through a shaft.

16. The garment steamer with the inclination-angle-adjustable ironing board according to claim 15, wherein the swing rod is assembled on the first connecting rod, the second connecting rod, or the ironing board.

17. The garment steamer with the inclination-angle-adjustable ironing board according to claim 1, wherein the base frame and the support structure are integrally manufactured.

18. The garment steamer with the inclination-angle-adjustable ironing board according to claim 1, wherein the base frame is assembled on the support structure.

* * * * *